US012156598B1

(12) United States Patent
Geng

(10) Patent No.: US 12,156,598 B1
(45) Date of Patent: Dec. 3, 2024

(54) MULTIFUNCTIONAL LEARNING TOWER

(71) Applicant: Su Zhou Ke Xi Lan Mao Yi You Xian Gong Si, Jiangsu (CN)

(72) Inventor: Xiaohang Geng, Jiangsu (CN)

(73) Assignee: Su Zhou Ke Xi Lan Mao Yi You Xian Gong Si, Suzhou (CN)

( * ) Notice: Subject to any disclaimer, the term of this patent is extended or adjusted under 35 U.S.C. 154(b) by 0 days.

(21) Appl. No.: 18/664,255

(22) Filed: May 14, 2024

(30) Foreign Application Priority Data

Nov. 14, 2023 (CN) ..... 202323060333.7

(51) Int. Cl.
*A47D 3/00* (2006.01)
*A47D 1/00* (2006.01)

(52) U.S. Cl.
CPC ..... *A47D 3/005* (2013.01); *A47D 1/00* (2013.01)

(58) Field of Classification Search
CPC .. A47B 85/00; A47B 2009/006; A47D 3/005; A47D 1/00
USPC ..... 108/11, 12, 13, 17
See application file for complete search history.

(56) References Cited

U.S. PATENT DOCUMENTS 232,599 A * 9/1880 Crandall ..... A47B 41/02 434/432
358,486 A * 3/1887 Seibert ..... A47B 85/08 312/282
578,407 A * 3/1897 Kuhler et al. ..... A47B 1/03 108/17
626,513 A * 6/1899 Varns ..... A47B 1/03 108/17
696,462 A * 4/1902 Markstrom ..... A47B 88/90 312/270.3
1,348,262 A * 8/1920 Brockway ..... A63H 3/52 312/351
1,889,901 A * 12/1932 Millard ..... A47B 85/06 108/17
1,929,551 A * 10/1933 Hamilton ..... A47B 39/02 38/104
2,354,106 A * 7/1944 Cooper ..... A47B 17/036 312/282

(Continued)

FOREIGN PATENT DOCUMENTS

CN 215936901 U 3/2022
DE 102020133471 A 5/2022
EP 3876795 A 11/2022

*Primary Examiner* — Jose V Chen

(57) ABSTRACT

The utility model discloses a multifunctional learning tower, belonging to the technical field of kids furniture, comprising a bearing component, wherein a writing component for learning is mounted at the upper end of the bearing component; the writing component comprises a second table plate, a second connecting frame, an anti-fall bar, mounting holes, a whiteboard and a round hole; and a connecting component for connecting the bearing component and the writing component is mounted at the lower end of the writing component. In the mode above, the utility model is capable of cultivating the learning interest of children, and also developing hobbies of children, and is multi-purpose since the utility model can be turned into a desk, thus saving resources and space. A mounting mode of buckle is not used, but a threaded connecting rod for rotational mounting is adopted instead, being firm and durable with no risk of scratching children.

5 Claims, 6 Drawing Sheets

(56) References Cited

U.S. PATENT DOCUMENTS 2,447,480 A * 8/1948 Stubbs ..... A47B 35/00 312/282
2,598,128 A * 5/1952 Liechty ..... A47B 19/08 182/132
2,614,611 A * 10/1952 Robertson ..... A47C 3/00 190/18 R
2,829,939 A * 4/1958 Hoppe ..... A47B 17/036 108/17
2,844,257 A * 7/1958 Friedman ..... A47B 31/04 108/11
2,913,122 A * 11/1959 Lomas ..... A47B 5/02 108/17
2,918,108 A * 12/1959 Sturmhoefel ..... A47C 12/02 108/12
3,233,942 A * 2/1966 Creutz ..... A47B 85/00 297/118
3,244,124 A * 4/1966 Schafer ..... A47B 13/00 108/17
3,361,088 A * 1/1968 Hodgkin ..... A47B 9/00 108/124
3,744,845 A * 7/1973 Sooker ..... A47C 13/00 108/150
3,967,562 A * 7/1976 Anacker ..... A47B 9/00 108/12
4,148,264 A * 4/1979 Caravias ..... A47B 3/00 108/69
4,161,915 A * 7/1979 Varmuza ..... A47B 9/00 108/12
4,572,081 A * 2/1986 Copeland ..... A47B 1/03 108/177
4,618,183 A * 10/1986 Bauer ..... A47C 13/00 297/3
6,164,211 A * 12/2000 Faris ..... A47B 85/06 108/11
6,174,026 B1 * 1/2001 Wise ..... A47C 13/00 108/17
6,516,731 B1 * 2/2003 Park ..... A47B 41/00 108/153.1
11,039,693 B2 6/2021 Gullick
2002/0117091 A1 * 8/2002 Stem ..... A47B 1/04 108/13
2007/0039150 A1 * 2/2007 Thomas ..... A47B 85/00 29/401.1
2007/0192956 A1 * 8/2007 Street ..... A47C 17/045 5/28
2007/0215011 A1 * 9/2007 Khan ..... A45C 9/00 108/11
2013/0032062 A1 * 2/2013 Raccah ..... A47B 85/06 108/42
2022/0386790 A1 12/2022 Harris
2023/0157445 A1 * 5/2023 Abbott ..... G06F 1/1601 108/26
2024/0156270 A1 * 5/2024 Wang ..... A47C 13/005

* cited by examiner

MULTIFUNCTIONAL LEARNING TOWER

TECHNICAL FIELD

The present utility model relates to the technical field of kids furniture, and in particular to a multifunctional learning tower.

BACKGROUND

Aiming to cultivate independence and learning skills of children while briefly freeing parents, learning towers also provide opportunities for recreation and parent-child interaction, engaging parents and children together and fostering the development of the parent-child relationship.

The Chinese utility model CN215936901U discloses a learning tower, including a bearing part with a bearing surface and a rail, wherein the rail is connected with the bearing part through a connecting structure to constrain a human body on the bearing surface; the connecting structure includes a first mounting hole formed in the rail and a second mounting hole formed in the bearing part, and is mounted in the first mounting hole and the second mounting hole through a fastening part to detachably connect the bearing part and the rail; the fastening part can be a bolt or screw; and when a child does not need the learning tower, the rail of the learning tower can be detached, and the bearing part can be used as a chair or a standing stool for children.

However, when the learning tower of the patent is turned into a chair or a standing stool for children, the fastening part needs to be detached, and the fastening parts are tedious to detach because of the large number.

Based on this, the utility model designs a multifunctional learning tower to solve the problem above.

SUMMARY

Aiming to the above disadvantages in the prior art, the utility model provides a multifunctional learning tower.

In order to achieve the above objective, the utility model is implemented through the following technical solution:

A multifunctional learning tower, including a bearing component;

wherein a writing component for learning is mounted at the upper end of the bearing component;

the writing component includes a second table plate, a second connecting frame, an anti-fall bar, mounting holes, a whiteboard and a round hole; the bearing component is connected with the second table plate; both the front and rear ends of the second table plate are fixedly connected with the second connecting frame; the anti-fall bar is fixedly connected at the left end of the second connecting frame; the whiteboard is fixedly connected at the right end of the second connecting frame; mounting holes are formed in both the front and rear sides of the lower end of the second table plate; the round hole is formed in the left side of the upper end of the second connecting frame; the mounting holes are connected with the connecting component;

and a connecting component for connecting the bearing component and the writing component is mounted at the lower end of the writing component.

Further, thread grooves are formed inside the mounting holes.

Further, the bearing component includes a first table plate, a first connecting frame, a sitting board and through holes; both the front and rear ends of the first table plate are fixedly connected with the first connecting frame; the sitting board is fixedly connected with the left end of the first connecting frame; through holes are formed in both the front and rear sides of the upper end of the first table plate; and the through holes are connected with the connecting component.

Further, the first table plate and the second table plate are rotationally connected.

Further, the connecting component includes a bandage and a threaded connecting rod; one end of the threaded connecting rod is embedded into the mounting hole and is in threaded connection with the mounting hole; and the other end of the threaded connecting rod penetrates through the through hole and is in sliding connection with the through hole.

Further, when the learning tower is turned into a desk, the bandage is in detachable connection with the first connecting frame and the second connecting frame; and the threaded connecting rod is connected with the second connecting frame.

Further, the threaded connecting rod is column-shaped.

further, the length of the second connecting frame in the up and down direction is smaller than that of the first connecting frame.

Further, the length of the first table plate 11 and the second table plate 21 in the front and back direction is the same as that in the left and right direction.

Further, the bandage is a bandage with a hook and loop fastener.

The utility model has the following technical effects:

Children can write and draw on the whiteboard of the utility model, being beneficial to cultivating the learning interest and hobbies of children, and the anti-fall bar and the second connecting frame can prevent children from falling from the learning tower, making parents feel at ease, and briefly freeing hands of parents.

When the learning tower of the utility model is turned into the desk, children can sit on the sitting board and study and write on the first table plate and the second table plate.

To turn the learning tower of the utility model into the desk, the threaded connecting rod is rotated to disconnect the upper end of the threaded connecting rod from the mounting hole and the through hole, the threaded end of the threaded connecting rod is aligned to the round hole, the threaded connecting rod is rotated, subsequently the second connecting frame is rotated rightwards, then the second connecting frame drives the second table plate, the whiteboard and the anti-fall bar to rotate until the second table plate is flush with the first table plate, and then the learning tower is turned into the desk.

The utility model is capable of cultivating the learning interest of children, and also developing hobbies of children, and is multi-purpose since the utility model can be turned into the desk, thus saving resources and space. A mounting mode of buckle is not used, but the threaded connecting rod for rotational mounting is adopted instead, being firm and durable with no risk of scratching children.

BRIEF DESCRIPTION OF DRAWINGS

In order to more clearly illustrate the technical solution in the embodiment of the utility model or in the prior art, a brief introduction to the accompanying drawing needed in the embodiment or the description in the prior art will be provided below. Apparently, the accompanying drawings described below are merely some embodiments of the utility model, and those of ordinary skill in the art may also derive other accompanying drawings from these accompanying drawings without making inventive efforts.

REFERENCE NUMERALS

1. Bearing component; 11. First table plate; 12. First connecting frame; 13. Sitting board; 14. Through hole; 2. Writing component; 21. Second table plate; 22. Second connecting frame; 23. Anti-fall bar; 24. Mounting hole; 25. Whiteboard; 26. Round hole; 3. Connecting component; 31. Bandage; 32. Threaded connecting rod.

DETAILED DESCRIPTION OF THE EMBODIMENTS

In order to make the objectives, the technical solutions and the advantages of the embodiments of the utility model clearer, the technical solutions of the embodiments of the utility model will be clearly and completely described below in combination with the accompanying drawings in the embodiments of the utility model. Apparently, the embodiments described above are only a part, but not all, of the embodiments of the utility model. Based on the embodiments of the utility model, all the other embodiments obtained by that of ordinary skill in the art without inventive effort are within the scope of the utility model.

The utility model will be further described in detail below with reference to the embodiments.

Figure 1:
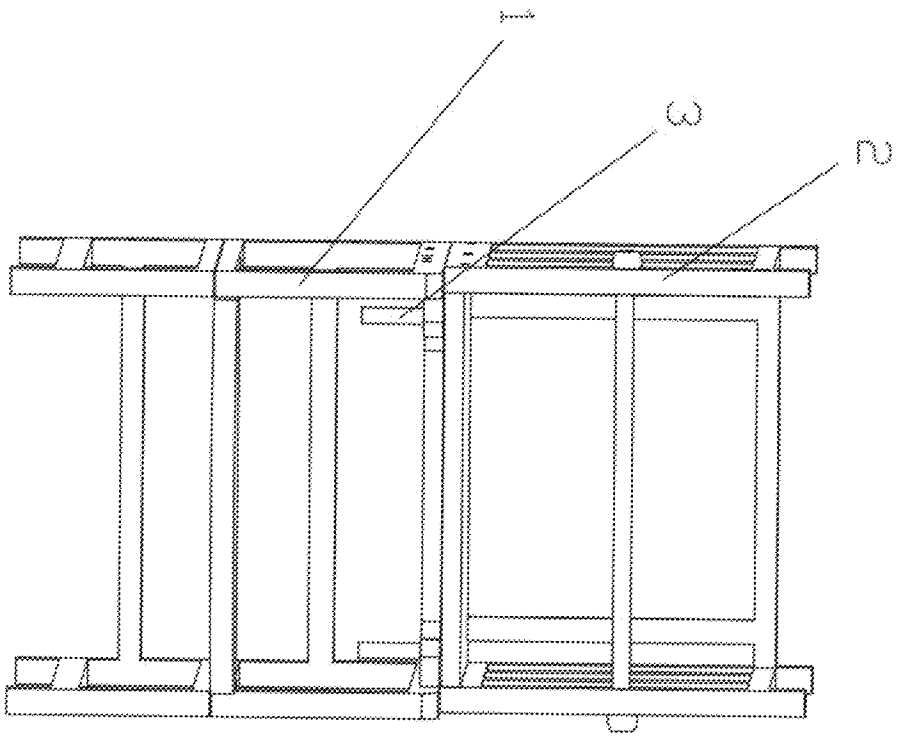
FIG. 1 is a stereoscopic diagram I of a multifunctional learning tower of the utility model.
Figure 2:
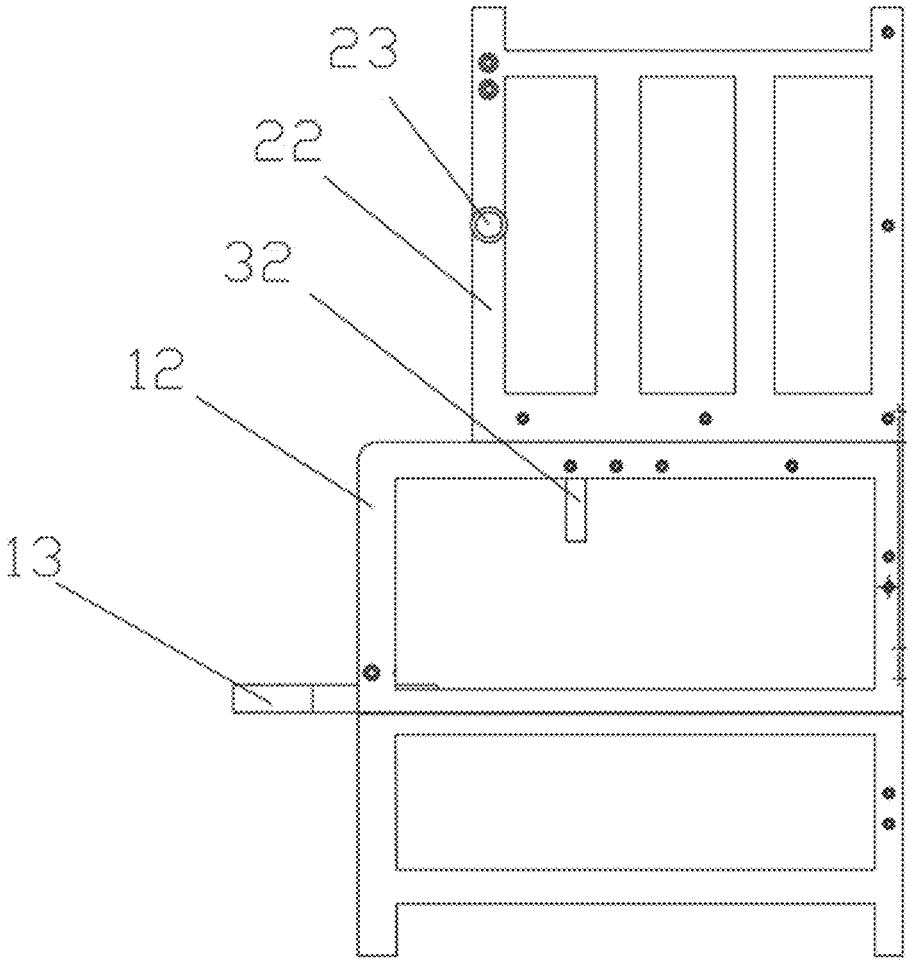
FIG. 2 is a front view of a multifunctional learning tower of the utility model.
Figure 3:
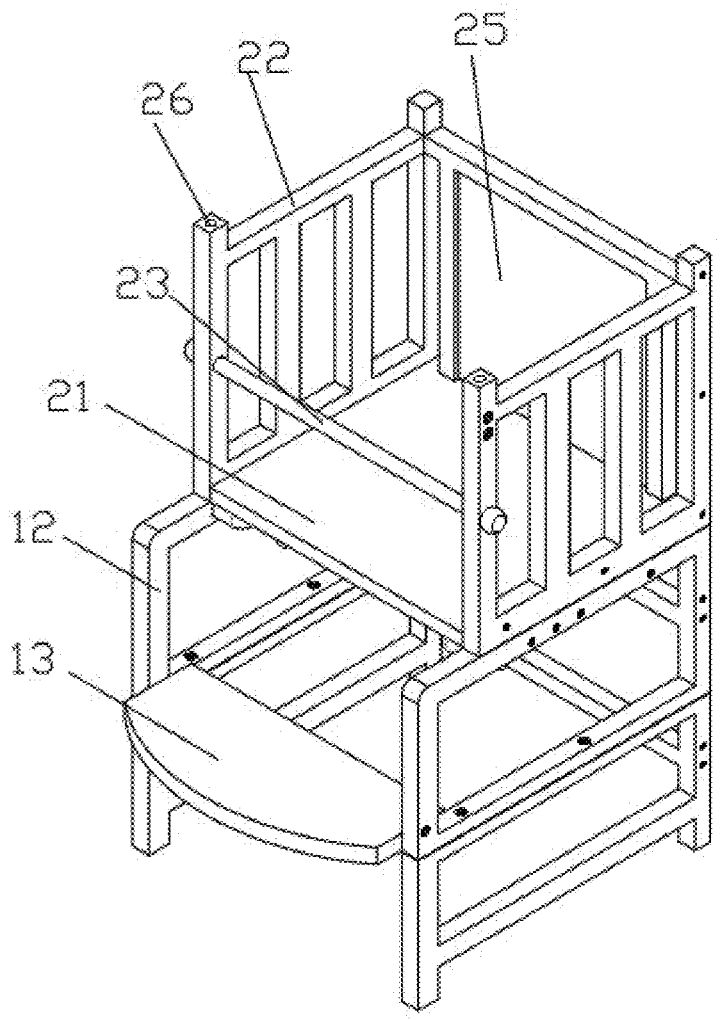
FIG. 3 is a stereoscopic diagram II of a multifunctional learning tower of the utility model.
Figure 4:
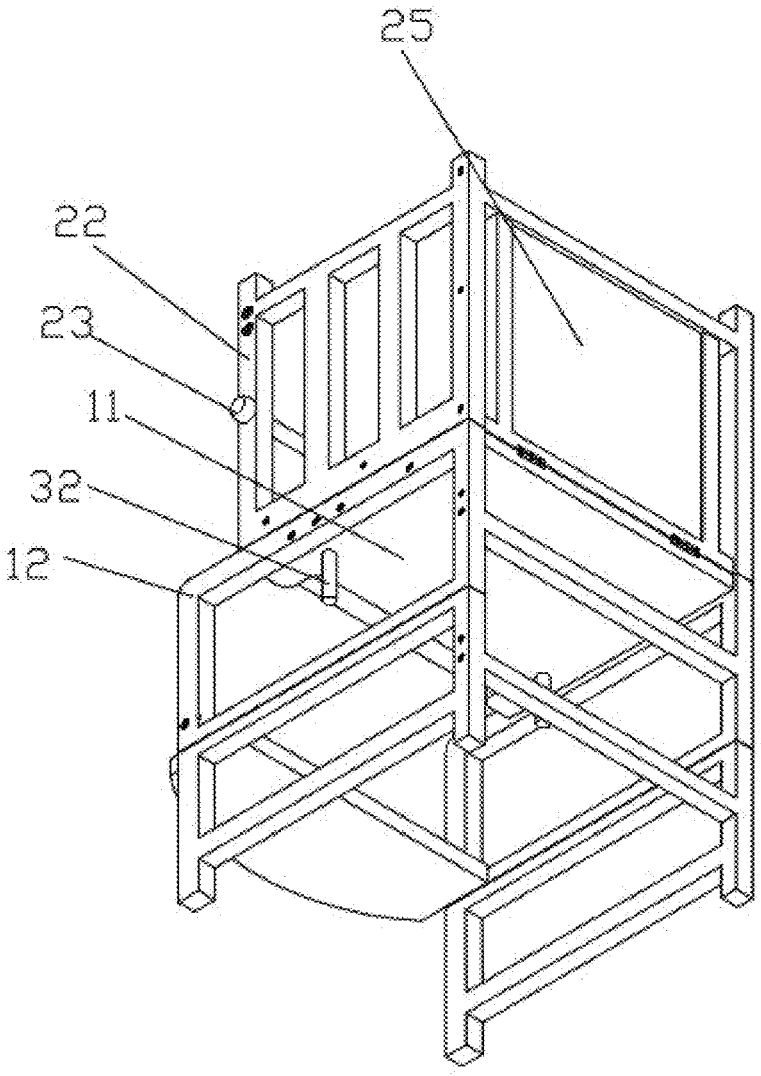
FIG. 4 is a stereoscopic diagram III of a multifunctional learning tower of the utility model.
Figure 5:
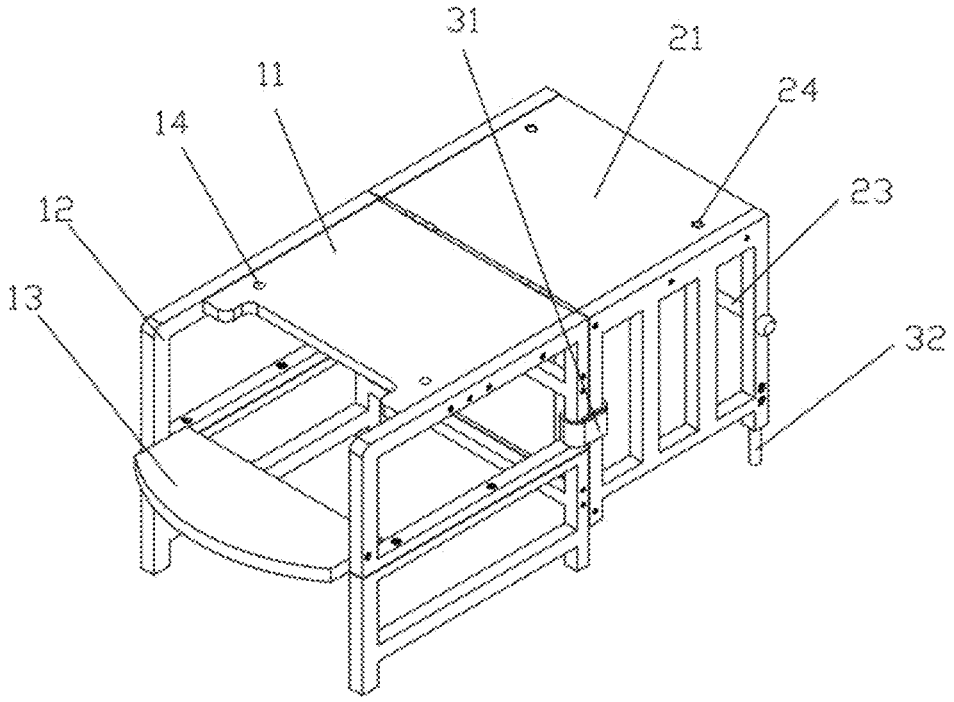
FIG. 5 is a stereoscopic diagram I of a multifunctional learning tower turned into a desk of the utility model.
Figure 6:
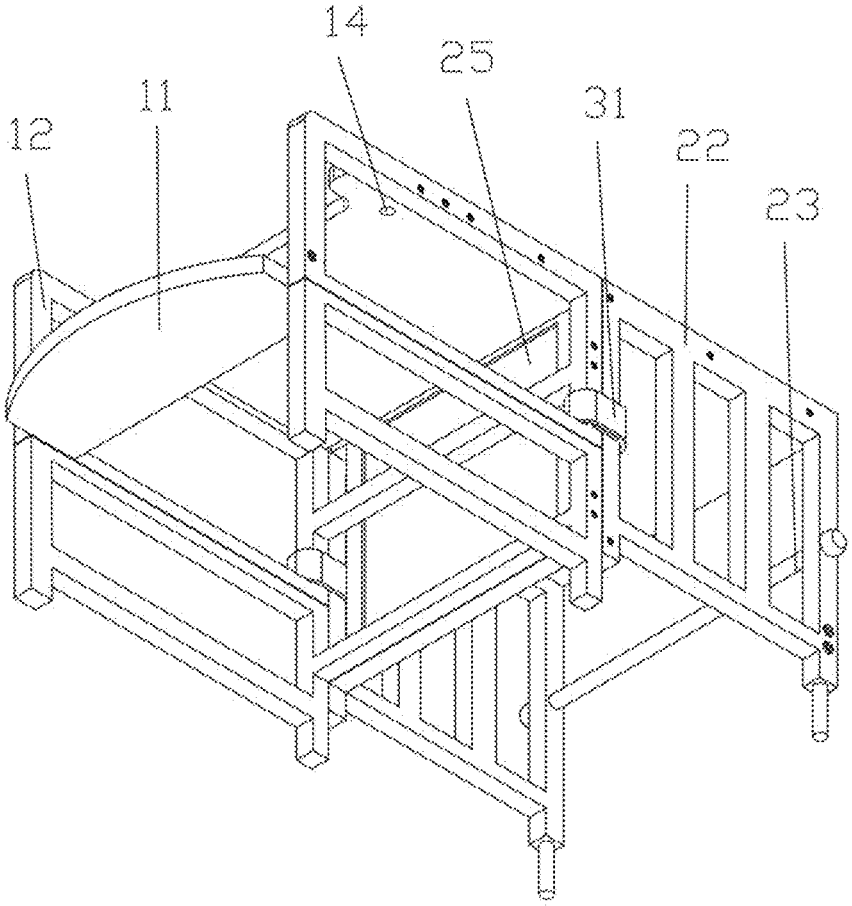
FIG. 6 is a stereoscopic diagram II of a multifunctional learning tower turned into a desk of the utility model.

In some embodiments, referring to FIG. 1-6 of the specification, a multifunctional learning tower, including a bearing component 1;

wherein a writing component 2 for learning is mounted at the upper end of the bearing component 1;

the writing component 2 includes a second table plate 21, a second connecting frame 22, an anti-fall bar 23, mounting holes 24, a whiteboard 25 and a round hole 26; the bearing component 1 is connected with the second table plate 21; both the front and rear ends of the second table plate 21 are fixedly connected with the second connecting frame 22; the anti-fall bar 23 is fixedly connected at the left end of the second connecting frame 22; the whiteboard 25 is fixedly connected at the right end of the second connecting frame 22; mounting holes 24 are formed in both the front and rear sides of the lower end of the second table plate 21; the round hole 26 is formed in the left side of the upper end of the second connecting frame 22; the mounting holes 24 are connected with the connecting component 3;

and a connecting component 3 for connecting the bearing component 1 and the writing component 2 is mounted at the lower end of the writing component 2.

Thread grooves are formed inside the mounting holes 24.

Children can write and draw on the whiteboard 25, being beneficial to cultivating the learning interest and hobbies of children, and the anti-fall bar 23 and the second connecting frame 22 can prevent children from falling from the learning tower, making parents feel at ease, and briefly freeing hands of parents.

The bearing component 1 includes a first table plate 11, a first connecting frame 12, a sitting board 13 and through holes 14; both the front and rear ends of the first table plate 11 are fixedly connected with the first connecting frame 12; the sitting board 13 is fixedly connected with the left end of the first connecting frame 12; through holes 14 are formed in both the front and rear sides of the upper end of the first table plate 11; and the through holes 14 are connected with the connecting component 3.

The first table plate 11 and the second table plate 21 are rotationally connected.

When the learning tower is turned into the desk, children can sit on the sitting board 13 and study and write on the first table plate 11 and the second table plate 21.

The connecting component 3 includes a bandage 31 and a threaded connecting rod 32; one end of the threaded connecting rod 32 is embedded into the mounting hole 24 and is in threaded connection with the mounting hole 24; and the other end of the threaded connecting rod 32 penetrates through the through hole 14 and is in sliding connection with the through hole 14.

When the learning tower is turned into a desk, the bandage 31 is in detachable connection with the first connecting frame 12 and the second connecting frame 22; and the threaded connecting rod 32 is connected with the second connecting frame 22.

Preferably, the threaded connecting rod 32 is column-shaped.

Preferably, the length of the second connecting frame 22 in the up and down direction is smaller than that of the first connecting frame 12.

To turn the learning tower into the desk, the threaded connecting rod 32 is rotated to disconnect the upper end of the threaded connecting rod 32 from the mounting hole 24 and the through hole 14, the threaded end of the threaded connecting rod 32 is aligned to the round hole 26, the threaded connecting rod 32 is rotated, subsequently the second connecting frame 22 is rotated rightwards, then the second connecting frame 22 drives the second table plate 21, the whiteboard 25 and the anti-fall bar 23 to rotate until the second table plate 21 is flush with the first table plate 11, and then the learning tower is turned into the desk.

The utility model is capable of cultivating the learning interest of children, and also developing hobbies of children, is multi-purpose since the utility model can be turned into a desk, thus saving resources and space. A mounting mode of buckle is not used, but the threaded connecting rod 32 for rotational mounting is adopted instead, being firm and durable with no risk of scratching children.

In some embodiments, as shown in FIG. 1-6, as a preferable embodiment of the utility model, preferably, the length of the first table plate 11 and the second table plate 21 in the front and back direction is the same as that in the left and right direction.

In some embodiments, as shown in FIG. 1-6, as a preferable embodiment of the utility model, preferably, the bandage 31 is a bandage with a hook and loop fastener.

The above embodiments are merely intended for describing the technical solution of the utility model rather than limiting the utility model. Although the utility model is described in detail with reference to the above embodiments, those of ordinary skill in the art should understand that they can still make modifications to the technical solution described in the embodiments or equivalent substitutions to some technical features of the technical solution. These modifications or substitutions do not enable the corresponding technical solution to depart from the spirit and scope of the technical solutions in all the embodiments of the utility model.

What is claimed is:

1. A multifunctional learning tower, comprising:

a bearing component (1);

wherein a writing component (2) for learning is mounted at the upper end of the bearing component (1);

the writing component (2) comprises a second table plate (21), a second connecting frame (22), an anti-fall bar (23), mounting holes (24), a whiteboard (25) and a round hole (26); the bearing component (1) is connected with the second table plate (21); both the front and rear ends of the second table plate (21) are fixedly connected with the second connecting frame (22); the anti-fall bar (23) is fixedly connected at the left end of the second connecting frame (22); the whiteboard (25) is fixedly connected at the right end of the second connecting frame (22); mounting holes (24) are formed in both the front and rear sides of the lower end of the second table plate (21); the round hole (26) is formed in the left side of the upper end of the second connecting frame (22); the mounting holes (24) are connected with the connecting component (3);

and a connecting component (3) for connecting the bearing component (1) and the writing component (2) is mounted at the lower end of the writing component (2);

wherein the bearing component (1) comprises a first table plate (11), a first connecting frame (12), a sitting board (13) and through holes (14); both the front and rear ends of the first table plate (11) are fixedly connected with the first connecting frame (12); the sitting board (13) is fixedly connected with the left end of the first connecting frame (12); through holes (14) are formed in both the front and rear sides of the upper end of the first table plate (11); and the through holes (14) are connected with the connecting component (3);

wherein the first table plate (11) and the second table plate (21) are rotationally connected;

wherein the connecting component (3) comprises a bandage (31) and a threaded connecting rod (32); one end of the threaded connecting rod (32) is embedded into the mounting hole (24) and is in threaded connection with the mounting hole (24); and the other end of the threaded connecting rod (32) penetrates through the through hole (14) and is in sliding connection with the through hole (14);

wherein when the learning tower is turned into a desk, the bandage (31) is in detachable connection with the first connecting frame (12) and the second connecting frame (22); and the threaded connecting rod (32) is connected with the second connecting frame (22).

2. The multifunctional learning tower according to claim 1, wherein thread grooves are formed inside the mounting holes (24).

3. The multifunctional learning tower according to claim 1, wherein the threaded connecting rod (32) is column-shaped.

4. The multifunctional learning tower according to claim 1, wherein the length of the second connecting frame (22) in the up and down direction is smaller than that of the first connecting frame (12).

5. The multifunctional learning tower according to claim 1, wherein the length of the first table plate (11) and the second table plate (21) in the front and back direction is the same as that in the left and right direction.

* * * * *